US006339691B1

(12) United States Patent
Kamei

(10) Patent No.: US 6,339,691 B1
(45) Date of Patent: Jan. 15, 2002

(54) IMAGE FORMING APPARATUS WITH A CONSTANT-CURRENT POWER SUPPLY

(75) Inventor: Chikashi Kamei, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/525,049

(22) Filed: Mar. 14, 2000

(51) Int. Cl.[7] ..... G03G 15/02; G03G 15/14
(52) U.S. Cl. ..... 399/315; 361/235; 399/50
(58) Field of Search ..... 399/50, 66, 315; 361/235

(56) References Cited

U.S. PATENT DOCUMENTS 4,341,457 A * 7/1982 Nakahata et al. ..... 399/315 X
4,346,986 A * 8/1982 Kuge et al. ..... 399/50
4,728,880 A * 3/1988 Walgrove ..... 361/235 X
5,012,282 A * 4/1991 Wanou et al. ..... 361/235 X
5,079,669 A * 1/1992 Williams ..... 361/235
5,339,144 A * 8/1994 Nakai et al. ..... 399/315
5,526,106 A * 6/1996 Katsumi et al. ..... 399/315 X
5,552,861 A * 9/1996 Mizude et al. ..... 399/50

FOREIGN PATENT DOCUMENTS

JP 61-215562 9/1986

* cited by examiner

*Primary Examiner*—Fred L. Braun
(74) *Attorney, Agent, or Firm*—Foley & Lardner

(57) ABSTRACT

An image forming apparatus includes a constant-current power supply to supply operation currents to a charging unit and a removing unit, and keep the total of the operation currents at a predetermined value; and a correction circuit to detect a fluctuation in the operation current of the removing unit, and correct the predetermined value of the constant-current power supply circuit according to the detection results.

6 Claims, 5 Drawing Sheets

IMAGE FORMING APPARATUS WITH A CONSTANT-CURRENT POWER SUPPLY

BACKGROUND OF THE INVENTION

There has been a image forming apparatus to irradiate a laser beam to a photoconductive drum of an image-carrying body from an exposing unit to form an electrostatic latent image on the surface of the photoconductive drum, make the electrostatic latent image visible by a developer (toner), and transfer the image onto a paper sheet.

In such a image forming apparatus, a photoconductive drum is rotatably provided below the exposing unit. A charging unit, a developing unit, a transferring unit, and a removing unit are disposed one after another, facing the surface of the photoconductive drum.

The charging unit charges the surface of the photoconductive drum with electrostatic charges. A laser beam emitted from the exposing unit is irradiated to the surface of the photoconductive drum to form an electrostatic latent image on the drum. The electrostatic latent image is made to appear as an visible image by a developer (toner) supplied from the developing unit.

The paper sheet is sent between the photoconductive drum and the transferring unit according to the rotation of the photoconductive drum. The transferring unit transfers the visible image (the image by the developer) on the photoconductive drum onto the sent sheet. The removing unit removes the charges of the sheet after passing through the transferring unit.

The charging unit comprises a metal case, and a electrifying wire provided in the metal case. Application of a D.C. voltage between the electrifying wire and the photoconductive drum causes electric discharge between the wire and the photoconductive drum to electrify the surface of the photoconductive drum. Moreover, there is caused electric discharge between the electrifying wire and the metal case. At the discharge, a direct current flows on a path between the electrifying wire and the photoconductive drum, and the total of both the direct currents becomes the operation current on the charging unit.

The removing unit comprises a metal case and a removing wire provided in the metal case. Application of a D.C. voltage between the removing wire and the metal case causes electric discharge between the removing wire and the metal case to remove the charges (that is, the charges caused on the paper sheet by the transferring unit) on the surface of a paper sheet passing on the removing unit through the transferring unit. And, when there is no sheet on the removing unit, or when the resistance of a sheet on the unit is small even in the presence of a sheet, the electric discharge is also caused between the removing wire and the photoconductive drum. At the electric discharge, a direct current flows through a path between the electrifying wire and the metal case, and a direct current is passed through a path between the electrifying wire and the photoconductive drum. The total of both the direct currents becomes an operation current of the removing unit.

Incidentally, the operation current of the removing unit is considerably small by a factor of about 1/10. Moreover, the polarity of the output of the removing unit is the same as that of the output of the charging unit.

Then, it is conceivable to use one power supply circuit in common both for the removing unit and for the charging unit to reduce the number of the parts and the cost.

However, it is necessary to keep the operation current of the charging unit at a predetermined value at any time. A fluctuation in the operation current of the charging unit causes density irregularities of copied image, particularly when copying photographic images with half tone density.

BRIEF SUMMARY OF THE INVENTION

Considering the above circumstances, the object of the invention is to offer a reliable image forming apparatus to use one power supply circuit in common both for an electrifying unit and for a removing unit, and keep the operation current of the charging unit at a predetermined value at any time.

An image forming apparatus of the invention is to form an electrostatic latent image on an image-carrying body, develop the latent image, and transfer the latent image on to a paper sheet, and comprises:

- charging unit to electrify the surface of the image-carrying body with electrostatic charges;
- an exposing unit to form an electrostatic latent image on the surface of an image-carrying body by irradiation of light on the surface of the image-carrying body after passing through the charging unit;
- an developing unit to develop the electrostatic latent image formed by the exposing unit;
- a transferring unit to transfer the image developed by the developing unit on the sheet;
- a removing unit to remove the sheet after passing through the transferring unit;
- a constant-current power supply circuit to supply operation currents to the charging unit and the removing unit, respectively, and keep the total of the operation currents at a predetermined value;
- a correction circuit to detect a fluctuation in the operation current of the removing unit, and correct the predetermined value of the constant-current power supply circuit according to the detection result.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

One embodiment of the invention will be described below.

Figure 1:
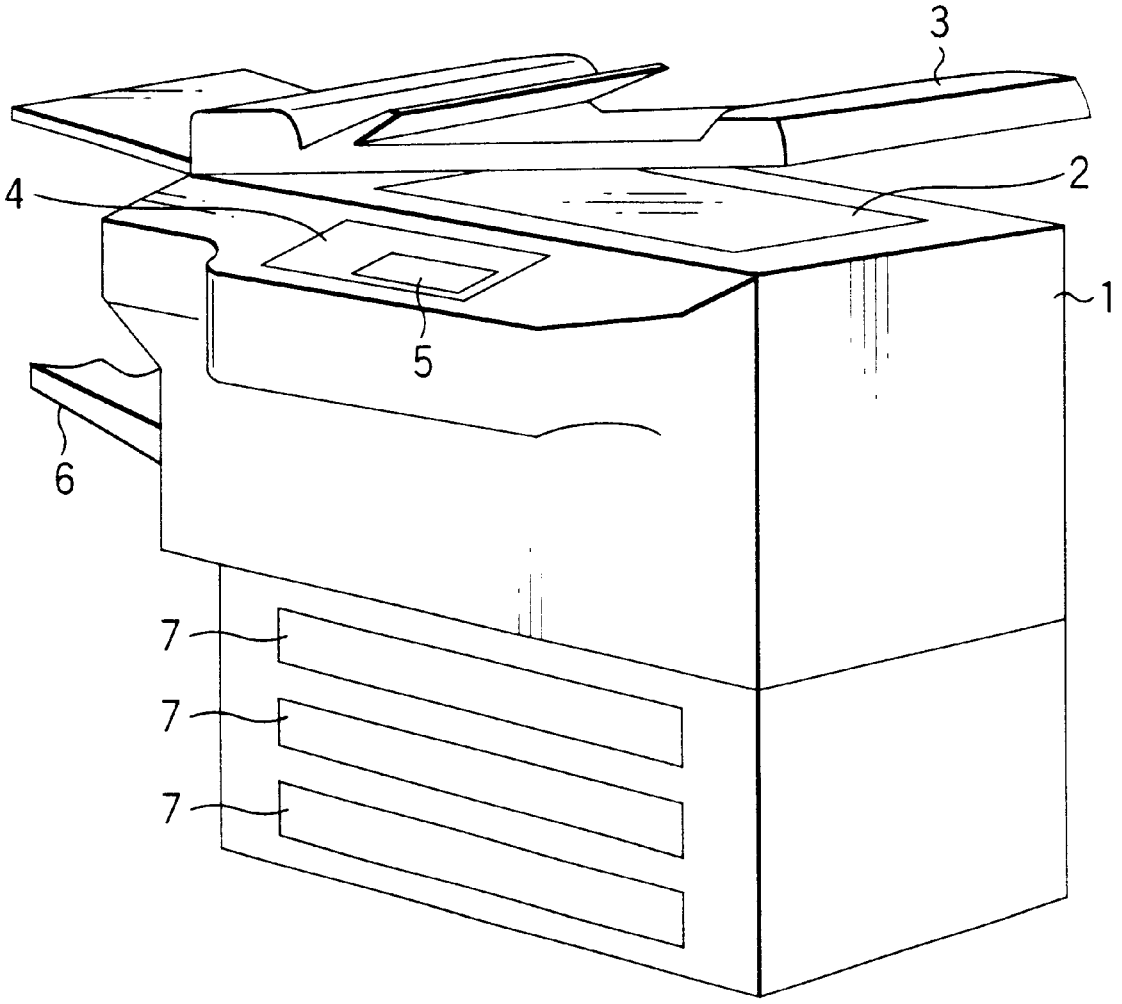
FIG. 1 shows an external appearances of an image forming apparatus according to one embodiment.

FIG. 1 shows an external appearances of an image forming apparatus, for example, an electronic copier.

An original table 2 of transparent glass is provided on the upper part of an main body 1. An automatic document feeder (ADF) 3 is openably provided on the original table 2. A sheet of original set on the upper part of the feeder 3 is automatically taken in one by one, and sent to the table 2.

A control panel 4 is provided adjacent to the original table 2 as an operation part in the upper part of the body 1. The control panel 4 with a display unit 5 as displaying means is provided to set starting and stopping of copying operation, the number of copies to be copied, a copying magnification, and a copying size.

A tray 6 is provided to receive paper sheets discharged after copying on the side of the main body 1. A plurality of paper sheet feeding cassettes 7 holding paper sheets for copying is provided in the lower part of the body 1.

Figure 2:
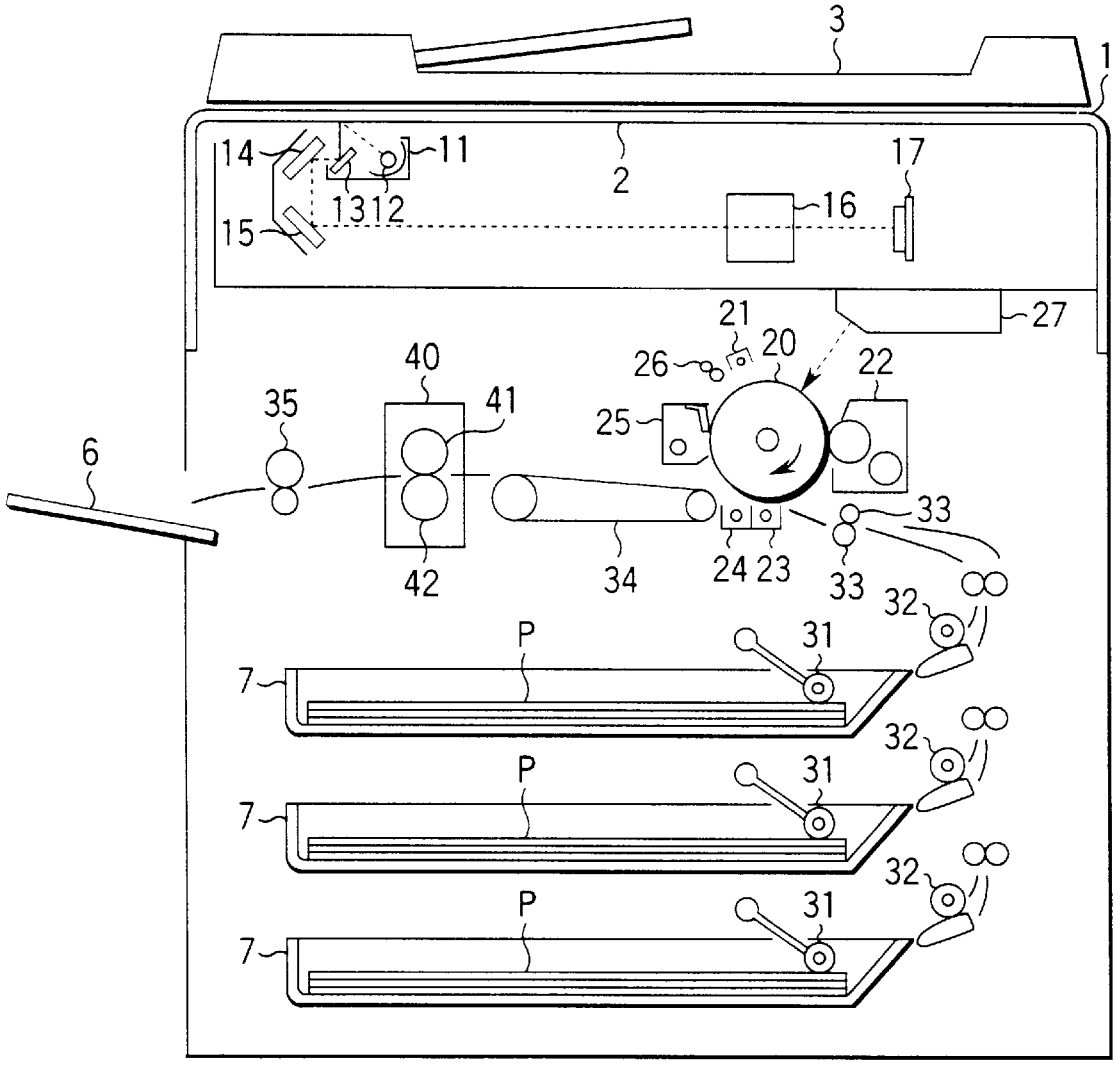
FIG. 2 shows a configuration of an inside of an image forming apparatus according to one embodiment.

FIG. 2 shows a configuration in the main body 1.

A carriage 11 is provided below the underside of the original table 2 in a reciprocating manner. An exposing lamp 12 is provided in the carriage 11. All over the surface of the original table 2 is optically scanned by the reciprocation of the carriage 11 while lighting of the lamp 12.

An reflected light image of the original put on the table 2 is obtained by the optical scanning, and the image is projected on a line sensor 17 of a CCD (charge coupled device) type line sensor (hereafter, called as CCD sensor) through reflecting mirrors 13, 14, 15, and a lens block 16 for changing the magnification. The CCD sensor 17 outputs an image signal at the voltage level corresponding to the received light. The image signal is sent to an exposing unit 27. The exposing unit 27 emits laser beam corresponding to the image signal.

A photoconductive drum 20, serving as an image-carrying body, is rotatably provided in the vicinity of the exposing unit 27. A charging unit 21, a developing unit 22, a transferring unit 23, a first removing unit 24, a cleaner 25, and a second removing unit 26 is disposed one after another around the photoconductive drum 20. A laser beam emitted from the above exposing unit 27 is irradiated on the surface of the photoconductive drum 20, passing between the charging unit 21 and the developing unit 22.

Each paper sheet feeding cassette 7 is provided in the lower part of the main body 1. Each paper sheet feeding cassette 7 holds many paper sheets P for copying. A pickup roller 31 to take a paper sheet P out one by one is provided in each paper sheet feeding cassette 7.

A paper sheet P is taken out one by one from any one of the paper sheet feeding cassettes 7 at copying. The sheet P taken out is separated from the paper sheet feeding cassette 7 with a separating unit 32 to the corresponding resist rollers 33, and is waiting for good timing with the rotation of the photoconductive drum 20. Each resist rollers 33 sends the sheet P between the transferring unit 23 and photoconductive drum 20, according to the rotation of the photoconductive drum 20.

The photoconductive drum 20 rotates in the direction of the arrow shown in the figure while copying. The charging unit 21 charges the surface of the photoconductive drum 20 with electrostatic charges. An electrostatic latent image is formed on the photoconductive drum 20 by the electrification, and application of the laser beam from the exposing unit 27 to the photoconductive drum 20.

The developing unit 22 supplies a developer to the photoconductive drum 20. The electrostatic latent image on the photoconductive drum 20 is made to appear as an visible image by supplying the developer. The transferring unit 23 transfers the appeared image on the photoconductive drum 20 onto the sheet P sent from each resist roller 33. The removing unit 24 removes charges on the sheet P after transferring. The sheet P after passing through the removing unit 24 is sent to a fixing device 40 by a carrying belt 34.

The fixing device 40 is provided with a heating roller 41 and a pressure roller 42, and fixes the image by the developer on the sheet P by heating with the heating roller 41, while carrying the sheet P under holding it between the both rollers. The sheet P is discharged to the tray 6 by a carrying roller after passing through the fixing device 40.

Figure 3:
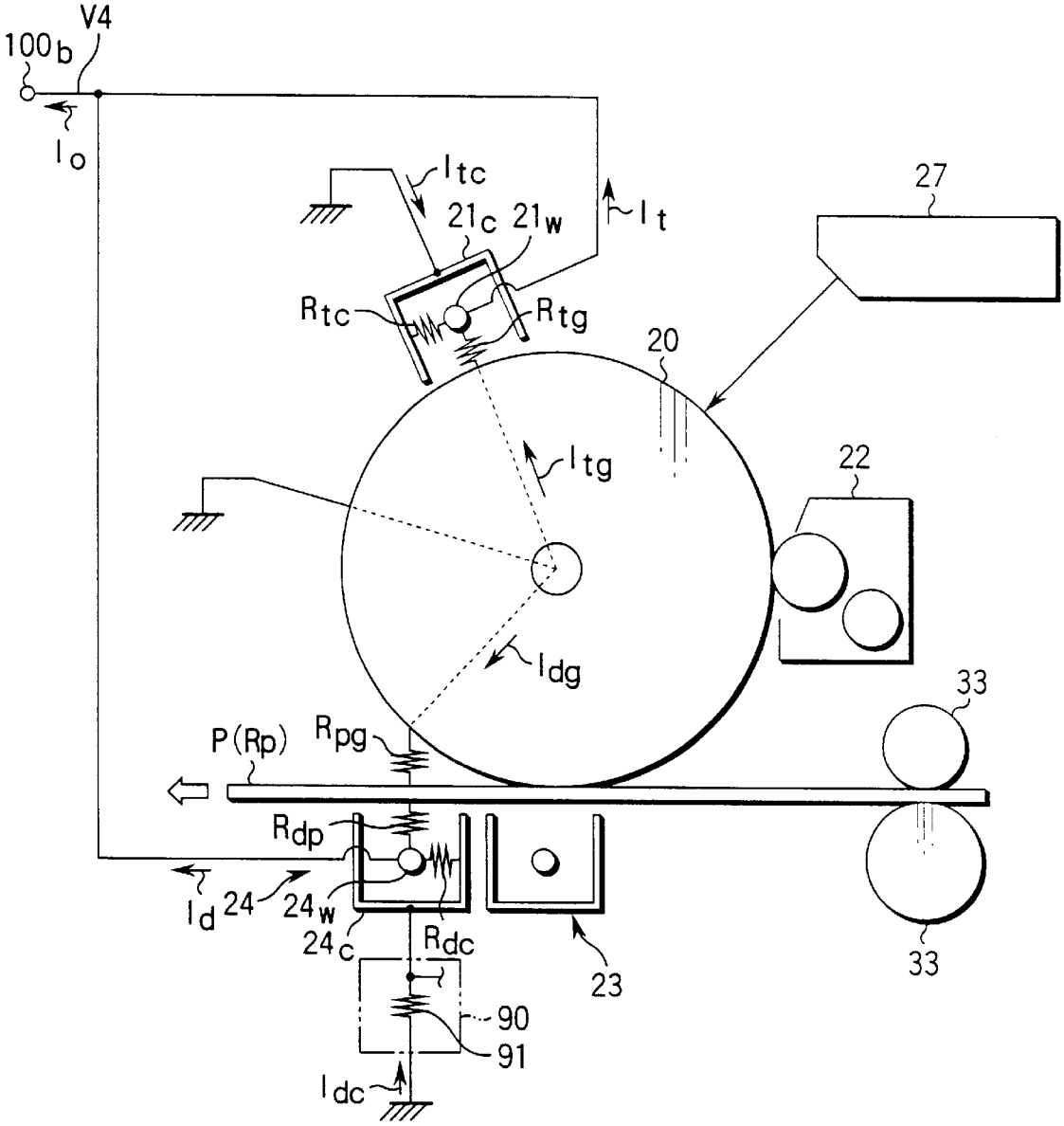
FIG. 3 shows a configuration of a photoconductive drum and the principal parts around the drum according to one embodiment.

FIG. 3 shows the photoconductive drum 20 and the principal parts around the drum.

The charging unit 21 comprises a metal case 21*c*, and an electrifying wire 21*w* provided in the metal case 21*c*. The metal case 21*c* and the electrifying wire 21*w* are extended along the axial direction of the photoconductive drum 20. The metal case 21*c* is grounded similarly to the photoconductive drum 20. The electrifying wire 21*w* is connected to the output terminal 100*b* of a constant-current power supply circuit 100 described below.

A D.C. voltage V4 generated between the output terminal 100*b* and the ground is applied between the electrifying wire 21*w* and the photoconductive drum 20, so that electric discharge between the electrifying wire 21*w* and the surface of the photoconductive drum 20 is generated. The surface of the photoconductive drum 20 are charged to an positive potential by the electric discharge. And the electric discharge is also caused between the electrifying wire 21*w* and the metal case 21*c*. At the electric discharge, a direct current Itg flows through a path between the electrifying wire 21*w* and the photoconductive drum 20, and a direct current Itc is passed through a path between the electrifying wire 21*w* and the metal case 21*c*. The total of the direct currents Itg and Itc becomes an operation current It of the charging unit 21.

There is a resistance Rtg between the electrifying wire 21*w* and the photoconductive drum 20 on the path where the direct current Itg flows. There is a resistance Rtc between the electrifying wire 21*w* and the metal case 21*c* on the path where the direct current Itc flows.

The removing unit 24 comprises a metal case 24*c*, and a removing wire 24*w* provided in the metal case 24*c*. The metal case 24*c* and the removing wire 24*w* are extended along the axial direction of the photoconductive drum 20. The metal case 24*c* is grounded similarly to the photoconductive drum 20 and the metal case 21*c*. The removing wire 24*w* is connected to the output terminal 100*b* of a constant-current power supply circuit 100 described below.

A D.C. voltage V4 between the output terminal 100*b* and the ground is applied between the removing wire 24*w* and the metal case 24*c*, so that electric discharge between the removing wire 24*w* and the metal case 24*c* is caused. The charges (charges charged to an positive potential by the transferring unit 23) on a paper sheet P passing on the removing unit 24 are removed by the electric discharge. And, when there is no paper sheet P on the removing unit 24, or when the resistance Rp of a paper sheet P on the unit is small even in the presence of a paper sheet P on the removing unit 24, the electric discharge is also caused between the removing wire 24*w* and the photoconductive drum 20. At the electric discharge, a direct current Idc flows through a path between the removing wire 24*w* and the metal case 24*c*, and a direct current Idg is passed through a path between the removing wire 24*w* and the photoconductive drum 20. The total of the direct currents Idc and Idg becomes an operation current Id of the removing unit 24. Moreover, the total of the operation current Id of the removing unit 24 and the current It of the charging unit 21 becomes an operation current Io of the constant-current power supply circuit 100.

There is a resistance Rdc between the removing wire 24*w* and the metal case 24*c* on the path where the direct current Idc flows. There is a resistance Rdp between the metal case 24*c* and a paper sheet P, resistance Rp of the sheet P, and a resistance Rpg between the sheet P and the photoconductive drum 20, between the removing wire 24*w* and the photoconductive drum 20 on the path where the direct current Idg flows.

Figure 4:
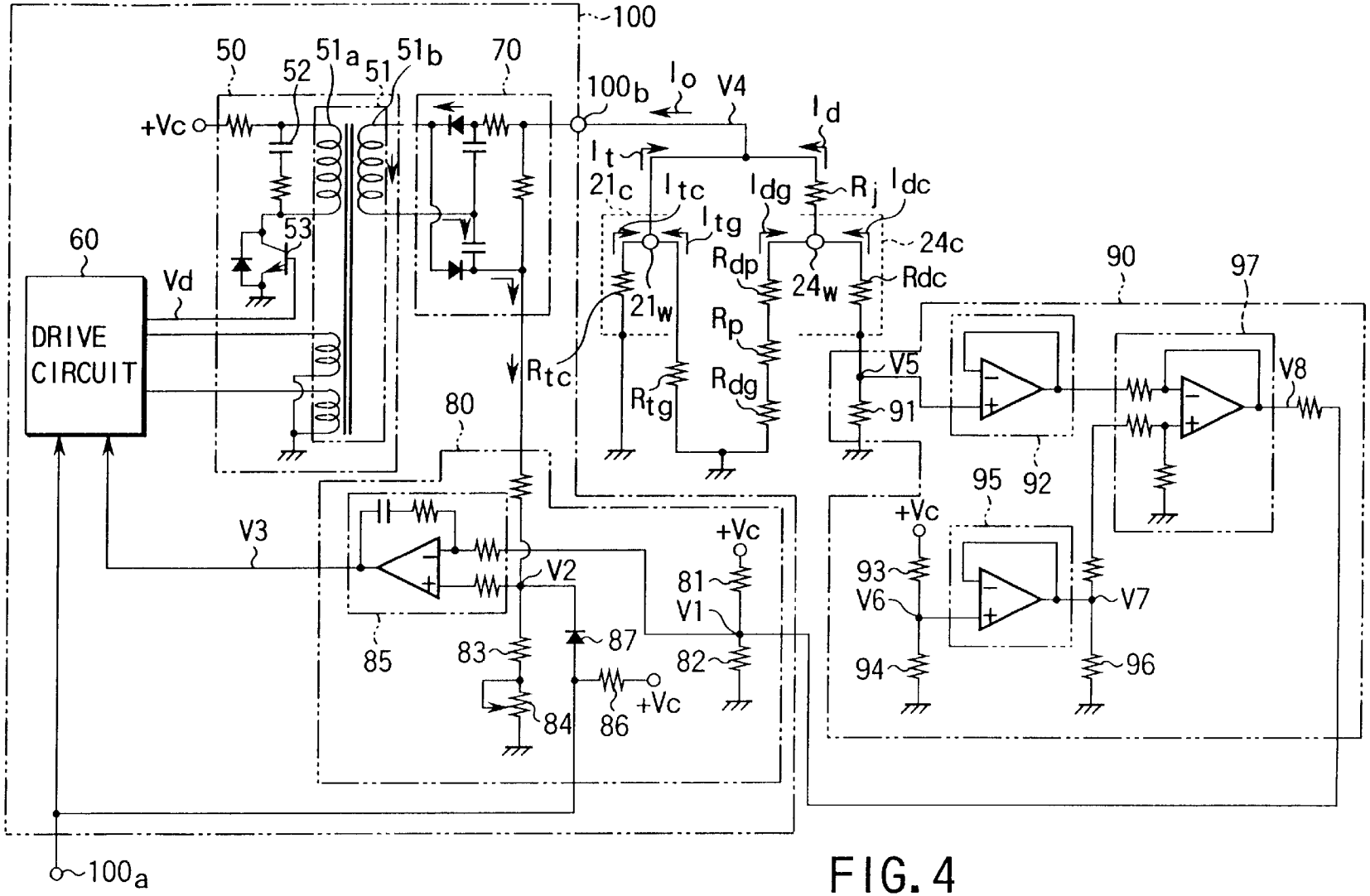
FIG. 4 shows a block diagram of an electric circuit according to one embodiment.

A current detection resistance 91 of a correction circuit 90 is inserted and connected between the metal case 24*c* and the ground, on the path where the direct current Idc flows. FIG. 4 shows the configuration of the correction circuit 90 and the constant-current power supply circuit 100.

The constant-current power supply circuit 100 comprises a switching circuit 50, a driving circuit 60, a rectifying circuit 70, and a current control circuit 80.

The switching circuit 50 comprises a transformer 51 having a primary coil 51*a* and a secondary coil 51*b*, a capacitor 52 composing a resonance circuit together with the primary coil 51*a* of the transformer 51, and a switching element 53 to excite the resonance circuit. And ON-OFF control operation of the switching element 53 according to a driving signal Vb output from the driving circuit 60 causes conversion of a D.C. power-supply voltage Vc supplied from the outside to an A.D. voltage of a predetermined level, and outputs the alternating voltage from the secondary coil 51*b* of the transformer 51.

The driving circuit 60 acts according to a ON-signal (logic "0" signal) input from the input terminal 100*a* to output a pulsing driving signal Vb with a changing duty ratio according to a level of the output voltage V3 of the current control circuit 80.

The rectifying circuit 70 rectifies the alternating voltage output from the switching circuit 50 to output the voltage to the output terminal 100*b*.

The current control circuit 80 comprises a series circuit with resistances 81, 82 under application with the D.C. power-supply voltage Vc; a series circuit with resistances 83, 84 connected to the output terminal 100*b* through the rectifying circuit 70; an amplifying circuit 85 to amplify the difference between a voltage V2 caused on the series circuit and a reference voltage V1 on the resistance 82; and a series circuit with a resistance 86 for application of the D.C. power-supply voltage Vc to a series circuit with the resistance 83 and the adjusting resistance 84, and a diode 87. The interconnection point between the resistance 86 and the diode 87 is connected to the input terminal 100*a*.

When an OFF signal (logic "1" signal) is input to the input terminal 100*a*, the D.C. power-supply voltage Vc is applied to the series circuit with the resistance 83 and the adjusting resistance 84. Thereby, the voltage V2 caused on the series circuit with the resistance 83 and the adjusting resistance 84 is forced to be in a high-level state to have the output voltage V3 of the amplifying circuit 85 in a high-level state.

Figure 5:
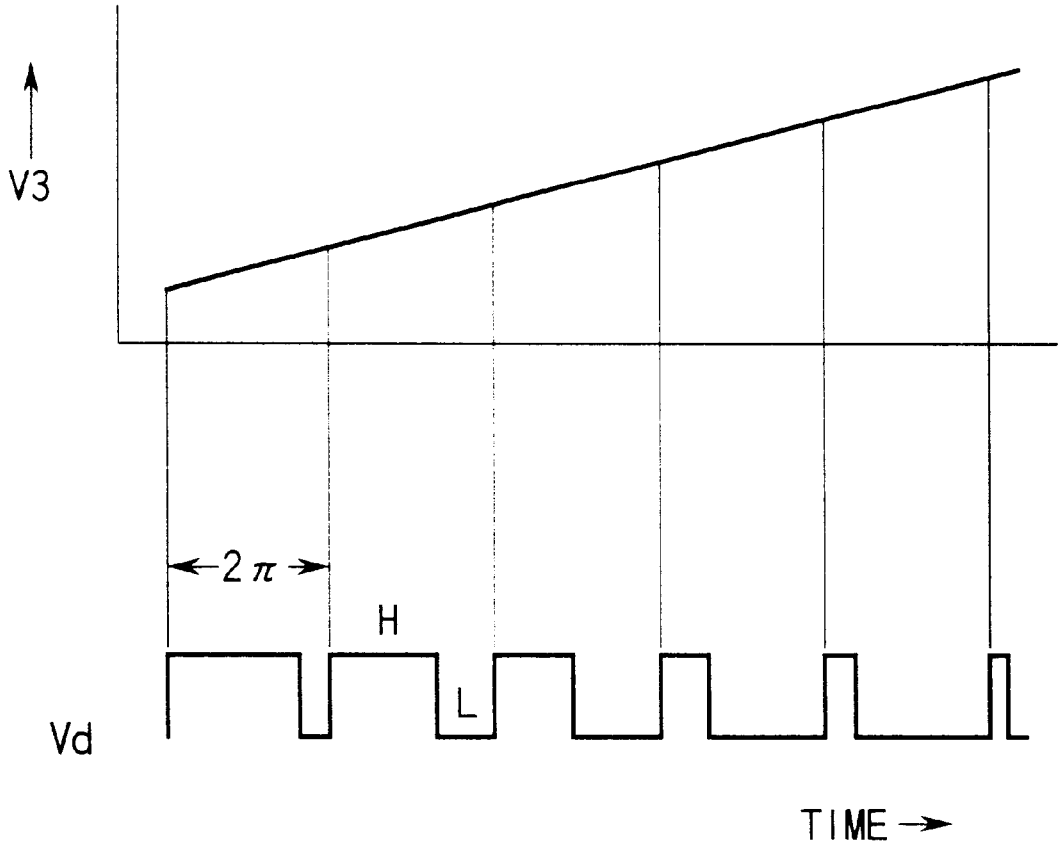
FIG. 5 shows a waveform of a signal on a constant-current power supply circuit in FIG. 4.

The higher level of the output voltage V3 of the amplifying circuit 85 causes the smaller duty ratio of the driving signal Vd output from the driving circuit 60, as shown in FIG. 5. In case of an OFF signal (logic "1" signal) input to the input terminal 100*a*, the duty ratio of the driving signal Vd becomes 0% to have the switching circuit 50 in a not-driven state.

In case of an ON signal (logic "0" signal) input to the input terminal 100*a*, the application of the D.C. power-supply voltage Vc to the series circuit with the resistance 83 and the adjusting resistance 84 is released. Thereby, the voltage V2 caused on the circuit with the resistance 83 and the adjusting resistance 84 changes according to the direct current Io (the total of the operation current Itc of the charging unit 21 and the operation current Id of the removing unit 24) output from the output terminal 100*b* through the rectifying circuit 70, that is, the output current Io of the constant-current power-supply circuit 100.

For example, when the output current Io is increased, the level of the voltage V2 is increased. When the level of the voltage V2 is increased, the level of the output voltage V3 of the amplifying circuit 80 is increased, and the duty ratio of the driving signal Vd changes in the decreasing direction. When the duty ratio of the driving signal Vd changes in the decreasing direction, the level of the output voltage of the switching circuit 50 decreases, and, accordingly, the output current Io changes in the decreasing direction.

When the output current Io is decreased, the level of the voltage V2 is decreased. When the level of the voltage V2 is decreased, the level of V3 on the amplifying circuit 85 is decreased, and the duty ratio of the driving signal Vd is changed in the increasing direction. When the duty ratio of the driving signal Vd is changed in the increasing direction, the level of the output voltage of the switching circuit 50 is increased, accordingly, the output voltage of the constant-current power supply circuit 100 is increased, and the output current Io is changed in the increasing direction.

The operation of the current control circuit 80 keeps the output current Io at a predetermined value, for example, 800 $\mu$A with a 720 $\mu$A of the rated operation current It of the charging unit 21, and a 80 $\mu$A of the rated operation current Id of the removing unit 24. Moreover, a resistance Rj is provided on the path where the operation current Id flows, in order to decrease the operation current Id of the removing unit 24 to a rated value of 80 $\mu$A. The reference value of the direct current Idc flowing between the removing wire 24*w* of the removing unit 24 and the metal case 24*c* becomes 72 $\mu$A.

However, the problem of such constant-current power supply circuit 100 is that the operation current Id of the removing unit 24 depends on the presence of a paper sheet P on the removing unit 24, and the kind of the paper sheet P (having different resistance Rp).

For example, when a paper sheet P with an infinite resistance Rp is on the removing unit 24, and the path of the direct current Idg is interrupted, the operation current Id decreases, followed by that the output current Io decreases. When the output current Io is decreased, the output voltage of the constant-current power supply circuit 100 is increased by the current control circuits 80 to adjust the output current Io in the increasing direction. The adjustment corrects the decrease in the operation current Id of the removing unit 24. However, when the output current Io is adjusted in the increasing direction, the operation current It of the charging unit 21 has a larger value than the rated value (=720 $\mu$A).

Though the fluctuation in the operation current Id of the removing unit 24 does not have much influence on image forming, there has been a problem that there is irregularities in the density of the copied image, when there is the fluctuation in the operation current It of the charging unit 21, particularly, when a photographic image with half-tone density is copied.

In order to solve the above problem, the correction circuit 90 is adopted. As mentioned above, the current detection resistance 91 of the correction circuit 90 is inserted and connected between the metal case 24*c* of the removing unit 24.

The correction circuit 90 detects the fluctuation in the operation current Id of the removing unit 24 with the current detection resistance 91 to correct the predetermined value (800 $\mu$A) of the constant-current power supply circuit 100 according to the detection results, and comprises an amplifying circuit 92 to amplify a voltage V5 caused on the current detection resistance 91 with a gain of "1"; a series circuit with resistances 93, 94 applied with the D.C. power-supply voltage Vc; an amplifying circuit 95 to amplify a reference voltage V6 caused on the resistance 94 with a gain of "1"; a resistance 96 applied with the output voltage of the amplifying circuit 95; and a differential amplifying circuit 97 to output a voltage at the level corresponding to the difference between the voltage V7 caused on the resistance 96 and the output voltage of the amplifying circuit 92. The output voltage of the differential amplifying circuit 97 is added to the current control circuit 82 as a correction voltage V8. As the current control reference voltage V1 is caused on the resistance 82, the level of the reference voltage V1 is made up according to the level of the correction voltage V8.

For example, when a paper sheet P with an infinity of resistance Rp is on the removing unit 24, and the path of the operation current Id is interrupted, the operation current Id decreases, followed by that direct current Idc flowing between the removing wire 24*w* and the metal case 24*c* also decreases to have the rise in the Voltage V5 caused on the current detection resistance 91. The rise in the voltage V5 is corresponding to the decrease in the operation current Id. When the voltage v5 rises, a correction voltage V8 of a negative level corresponding to the rise is output from the differential amplifying circuit 97. The reference voltage V1 of the current control circuit 80 decreases, according to the correction voltage V8 of a negative level.

When the reference voltage V1 decreases, the output voltage V3 of the current control circuit 80 rises, and the duty ratio of the driving signal Vd changes in the decreasing direction. The change in the duty ratio of the driving signal Vd in the decreasing direction causes the fall in the output voltage level of the switching circuit 50, followed by that the decrease in the output voltage of the constant-current power supply circuit 100 causes the change in the output current Io in the decreasing direction.

For example, when the operation current Id decreases by 8 $\mu$A, the output current Io becomes 792 $\mu$A by the operation of the correction circuit 90, though the output current Io is, usually, increased to 800 $\mu$A by increase in the direction to correct the decrease of 8 $\mu$A.

Therefore, the operation current It of the charging unit 21 is always kept at a rated value (=720 $\mu$A), regardless of the presence of a paper sheet P on the removing unit 24, and the kind of the paper sheet P (causes different resistance Rp). Thereby, even when photographic images with half tone density are copied, it is possible to produce good copies with no density irregularities.

Moreover, the operation current It to the charging unit 21 and the operation current Id to the removing units 24 may be supplied by one common constant-current power supply circuit 100 to reduce the number of parts and the cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus for forming an electrostatic latent image on an image-carrying body, developing the latent image, and transferring the latent image on to a paper sheet comprising:

a charging unit to electrify the surface of the image-carrying body with electrostatic charges;

an exposing unit to form an electrostatic latent image on the surface of an image-carrying body by irradiation of light on the surface of the image-carrying body after passing through the charging unit;

an developing unit to develop the electrostatic latent image formed by the exposing unit;

a transferring unit to transfer the image developed by the developing unit on the sheet;

a removing unit to remove the sheet after passing through the transferring unit;

a constant-current power supply circuit to supply operation currents to the charging unit and the removing unit, respectively, and keep the total of the operation currents at a predetermined value;

a correction circuit to detect a fluctuation in the operation current of the removing unit, and correct the predetermined value of the constant-current power supply circuit according to the detection result.

2. An image forming apparatus according to claim 1, wherein the constant-current power supply circuit comprises a switching circuit to convert a D.C. power-supply voltage Vc to an alternating voltage; a driving circuit to drive the switching circuit; a rectifying circuit to rectify the output voltage of the switching circuit; and a current control circuit to control driving of the driving circuit.

3. An image forming apparatus according to claim 1, wherein the charging unit comprising a metal case and an electrifying wire provided in the metal case charges the surface of the image-carrying body with electrostatic charges by electric discharge between the electrifying wire and the image-carrying body; and the removing unit comprising a metal case and a removing wire in the metal case removes the sheet by electric discharge between the removing wire and the metal case.

4. An image forming apparatus according to claim 3, wherein the correction circuit comprising a current detection resistance to detect a current flowing between the removing wire and the metal case of the removing unit detects a fluctuation in the operation current on the removing unit according to a voltage caused on the current detection resistance.

5. An image forming apparatus for forming an electrostatic latent image on an image-carrying body, developing the latent image, and transferring the latent image onto a paper sheet, comprising:

a charging unit comprising a metal case connected to a ground and an electrifying wire provided in the metal case, to electrify the surface of the image-carrying body with electrostatic charges by an electric discharge between the electrifying wire and the image-carrying body;

an exposing unit to form an electrostatic latent image on the surface of the image-carrying body by irradiation of light on the surface of the image-carrying body after passing through the charging unit;

a developing unit to develop the electrostatic latent image formed by the exposing unit;

a transferring unit to transfer the image developed by the developing unit on the sheet;

a removing unit comprising a metal case connected to a ground and a removing wire provided in the metal case, to remove charges on the sheet after passing through the transferring unit by an electric discharge between the removing wire and the metal case;

a constant-current power supply circuit comprising an output terminal to which the electrifying wire of the charging unit and the removing wire of the removing unit are connected, to supply operation currents to the charging unit and the removing unit, respectively, by applying a direct voltage between the output terminal and the ground, and to adjust a level of the direct voltage so as to keep the total of the operation currents at a predetermined value;

a current detection resistance provided in a connection line between the metal case of the removing unit and the ground, through which a current, which varies according to presence or absence of the sheet on the removing unit and a resistance of the sheet on the removing unit, passes; and a correction circuit to correct the predetermined value of the constant-current power supply circuit according to variations in voltage of the current detection resistance.

6. An image forming apparatus according to claim 5, wherein the constant-current power supply circuit comprises:

a switching current comprising a switching element, to convert a D.C. power-supply voltage Vc to an alternating voltage by turning the switching element on and off;

a rectifying circuit to rectify an output voltage of the switching circuit and applying the output voltage between the output terminal and the ground;

an amplifier circuit to amplify a difference between an output voltage level of the rectifying circuit and a reference voltage level corresponding to the predetermined value; and a driving circuit to turn the switching element of the switching circuit on and off by a duty ratio in accordance with an amplifier circuit output voltage level, and wherein the correction circuit corrects the reference voltage level according to variations in voltage of the current detection resistance.

* * * * *